US006460801B1

(12) United States Patent
Mayersak

(10) Patent No.: US 6,460,801 B1
(45) Date of Patent: Oct. 8, 2002

(54) PRECISION GUIDANCE SYSTEM FOR AIRCRAFT LAUNCHED BOMBS

(75) Inventor: Joseph R. Mayersak, Ashburn, VA (US)

(73) Assignee: Lockheed Martin Corp., Bethesda, MD (US)

( * ) Notice: Subject to any disclaimer, the term of this patent is extended or adjusted under 35 U.S.C. 154(b) by 0 days.

(21) Appl. No.: 09/862,843

(22) Filed: May 23, 2001

Related U.S. Application Data

(63) Continuation-in-part of application No. 08/953,607, filed on Oct. 19, 1997, now abandoned, which is a continuation-in-part of application No. 08/512,426, filed on Aug. 8, 1995, now abandoned, which is a continuation-in-part of application No. 08/295,108, filed on Aug. 24, 1994, now Pat. No. 5,507,452, which is a continuation-in-part of application No. 08/154,767, filed on Nov. 18, 1993, now Pat. No. 5,463,036.

(51) Int. Cl.[7] ..... B64C 15/14
(52) U.S. Cl. ..... 244/3.22; 244/52
(58) Field of Search ..... 244/52, 169, 3.21, 244/3.22

(56) References Cited

U.S. PATENT DOCUMENTS

| | | | | | |
|---|---|---|---|---|---|
| 4,085,909 | A | * | 4/1978 | East et al. | 244/3.21 |
| 4,463,921 | A | * | 8/1984 | Metz | 244/3.22 |
| 4,662,581 | A | * | 5/1987 | Samario | 244/3.22 |
| 4,747,568 | A | * | 5/1988 | Carrigan | 244/3.22 |
| 4,826,104 | A | * | 5/1989 | Bennett et al. | 244/3.22 |
| 4,928,906 | A | * | 5/1990 | Sturm | 244/3.22 |
| 4,955,558 | A | * | 9/1990 | Machell et al. | 244/3.22 |
| H1098 | H | * | 9/1992 | Hallum | 244/3.22 |

* cited by examiner

*Primary Examiner*—Galen L. Barefoot
(74) *Attorney, Agent, or Firm*—Charles E. Temko

(57) ABSTRACT

A jet bomb guidance system in which bi-directional nozzles are fired in a manner to produce force state changes resulting in improved level of control, greater force compatibility and greater efficiency in propellant fuel usage. The system includes four bi-directional nozzles spaced at 90 degree internals in which at least four single nozzles are open at any given instant to maintain a substantially constant gas pressure. The system may be positioned at the nose portion, tail portion, or center of gravity of the bomb.

16 Claims, 13 Drawing Sheets

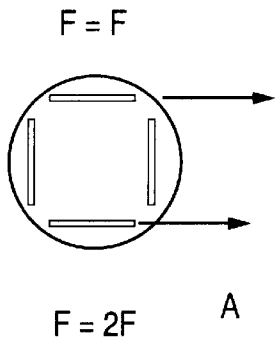

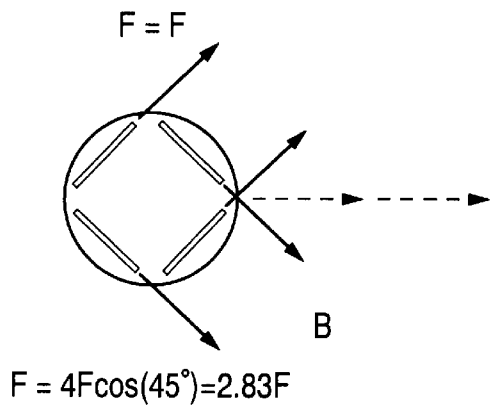

CONCEPT DIFFERENCES

- GREATER FORCE CAPABILITY
  - 41.5 PER-CENT HIGHER THRUST CAPABILITY
- MORE FORCE STATES
  - 33 COMPARED TO 15
- FOUR CONTROL PLANES
  - ROTATED AT 45 DEGREES RELATIVE TO EACH OTHER
  - ORTHOGONAL SETS
- FACTOR OF TEN LESS PROPELLANT USAGE
- NEUTRAL THRUST CONCEPT
  - BI-DIRECTIONAL NOZZLE FIRING BOTH WAYS
- FOUR NOZZLES OPEN AT ALL TIMES
  - CONSTANT PRESSURE SYSTEM WITHOUT PRESSURE REGULATION
- CONTROL BY FORCE STATE CHANGE RATHER THAN THRUST LEVEL
  - 25 MILLISECOND CYCLE RATE

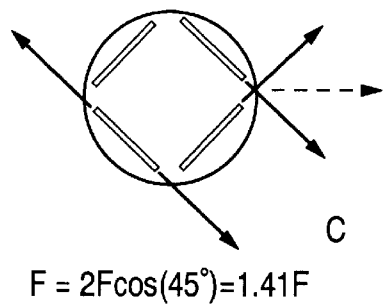

FIG. 1

FIG. 16
VALVE CYCLE TIME IN MILLISECONDS FOR TYPICAL TRAJECTORIES
| | TRAJECTORY A | | TRAJECTORY B | | TRAJECTORY C | |
|---|---|---|---|---|---|---|
| VALVE # | # CYCLES | OPEN TIME | # CYCLES | OPEN TIME | # CYCLES | OPEN TIME |
| 1 | 1078 | 26.95 s | 1094 | 27.35 s | 1045 | 26.125 s |
| 2 | 1364 | 34.1 s | 1354 | 33.85 s | 1414 | 35.35 s |
| 3 | 950 | 23.75 s | 975 | 24.375 s | 905 | 22.625 s |
| 4 | 1524 | 38.1 s | 1461 | 36.525 s | 1548 | 38.7 s |
| 5 | 1372 | 34.3 s | 1355 | 33.875 s | 1397 | 34.925 s |
| 6 | 1063 | 26.575 s | 1111 | 27.775 s | 1043 | 26.075 s |
| 7 | 1496 | 37.4 s | 1472 | 36.8 s | 1549 | 38.725 s |
| 8 | 945 | 23.675 s | 970 | 24.25 s | 891 | 22.275 s |
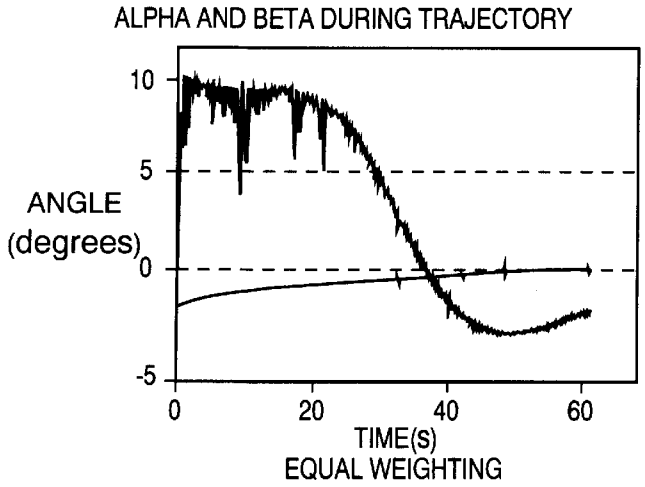
FIG. 17A
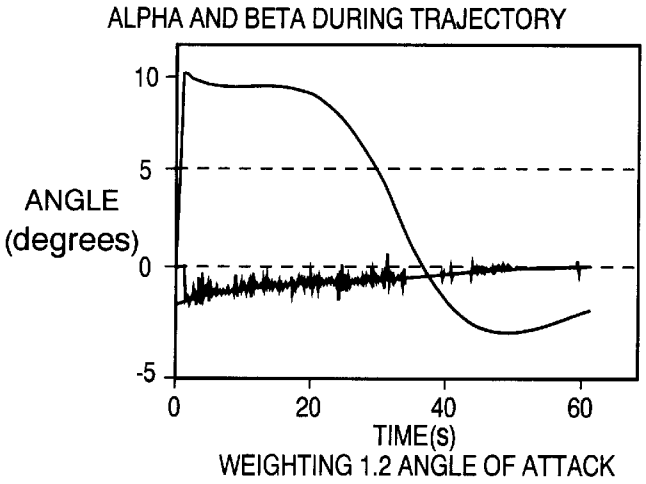
FIG. 17B

PRECISION GUIDANCE SYSTEM FOR AIRCRAFT LAUNCHED BOMBS

RELATED APPLICATION

Reference is made to my copending application Ser. No. 08/154,767 filed Nov. 18, 1998, now U.S. Pat. No. 5,463,036 the present application being a continuation in part thereof. Said application is a continuation in part of application Ser. No. 08/953,607 filed Oct. 19, 1997, now abandoned, which, in turn, is a continuation in part of application Ser. No. 08/512,426 filed Aug. 8, 1995, now abandoned, in turn a continuation-in-part of application Ser. No. 08/295,108 filed Aug. 24, 1994 now U.S. Pat. No. 5,507,452.

BACKGROUND OF THE INVENTION

This application relates generally to the field of maneuverable vehicle guidance. It relates to the guidance of space vehicles operating in an exoatmospheric environment and to guidance of air vehicles operating in an endoatmospheric environment. The application relates, in particular to the guidance of airframe ordinance which is released from a platform, typically a bomber or fighter aircraft. Such vehicles are commonly guided to the target with improved delivery accuracy using a variety of jet propulsion means powered by an onboard gas generator which is placed in operation at the time of launch and remains operational up to the point of impact. In the alternative, the propulsion means may be in the form of discrete solid propulsion thrusters.

As disclosed, for example, in the U.S. Pat. to Stein et al No. 5,076,511, where a gas generation system is used, there must be a feedback control to avoid excess manifold pressure or provision must be made for venting of at least one jet valve to continuously relieve at least some of the continuously generated gas. Neutral propulsion or zero propulsion is produced by opening two opposing valves simultaneously. The use of adjustable control surfaces is also possible, but because of necessary mechanical linkages, they are not practical for minor and continuous adjustments.

It is also known to provide a separately attachable modular booster to the tail of the vehicle as disclosed in the U.S. Pat. to Ripley—Lotee et al No. 4,364,530.

In the above mentioned co-pending application Ser. No. 08/154,767, there is disclosed a relatively simple jet reaction control means of size sufficiently small to permit it to be installed in a forwardly positioned fuse well, wherein laterally oriented forces are imparted to the nose of the vehicle rather than through the center of gravity, so as to act as control forces to place the air vehicle at a desired angle of attack and side slip to magnify the control force by taking advantage of vehicle lift generated by cross flow drag at a given angle of attack and yaw. The system includes compact gas generating means feeding each of four bi-directional nozzles located on the periphery of a valve plate positioned 90 degrees one from the other on a valve plate element fed by the gas generating means. The valve plate element includes four pairs of solenoid operated poppet valves, one for each nozzle, which are cycled at rapid periodic intervals to vent the system of excess pressure and to change the force states being generated by the bi-directional nozzles to in turn control the air vehicle angle of attack and side slip.

SUMMARY OF THE INVENTION

The present invention relates to an improved method of using the above-described construction which produces far more sensitive control of the vehicle on its path of flight to the target. Because there are eight nozzles arranged in four oppositely directed pairs, each capable of independent operation, it is possible to generate an increased number of force states which are instantaneously available to meet any given thrust requirement, which may include adjustment of pitch and yaw, as well as speed of axial rotation. The system can produce force in the pitch and yaw plane by firing nozzles opposite from each other in the same direction which generates a control force which can be represented by a force of 2F through the centerline of the air vehicle and two canceling roll torques. When two adjacent nozzles are opened to produce a control force of 2F cos 45 degrees and two equal but opposite forces of F since 45 degrees, the resultant force again passes through the centerline of the missile. The force vector generated in the two cases both pass through the centerline of the missile to preclude inducing roll and the resultant forces are positioned at 45 degrees. When used for pitch and yaw correction, the resultant forces pass through the center line of the vehicle. As a result, the disclosed system provides three unique modes of operation, not available in prior art construction. It is possible to fire two adjacent nozzles to generate a force level of 2F cost 45 degrees; or four adjacent nozzles to generate a force level of 4 F cos 45 degrees; or two opposite nozzles to generate a force of 2 F, or combinations of these nozzles to generate 33 different force states. In addition, it is possible to fire a single bi-directional nozzle in both directions simultaneously to generate a neutral force state for that nozzle which is useful in venting the system of excess gas pressure, and also to control the force obtained using one or more remaining nozzles for lateral propulsion without the necessity of varying the effective size of the nozzles. Thus, by firing adjacent nozzles together so that the result is a control force which passes through the center line of the vehicle, an increased number of force states in the pitch or yaw plane is made possible.

BRIEF DESCRIPTION OF THE DRAWINGS

In the drawings, to which reference will be made in the specification, similar reference characters have been employed to designate corresponding parts throughout the several views.

FIG. 1 is a schematic perspective view showing resultant force when two adjacent nozzles are fired and neutral force concepts used in an embodiment of the invention.

FIG. 16 describes the possible placement of the jet reaction control system on a bomb to include nose control, center of gravity control and tail control concepts.

FIG. 17 illustrates typical value cycle timing for sample trajections.

DETAILED DESCRIPTION O)F THE DISCLOSED EMBODIMENT

Figure 9:
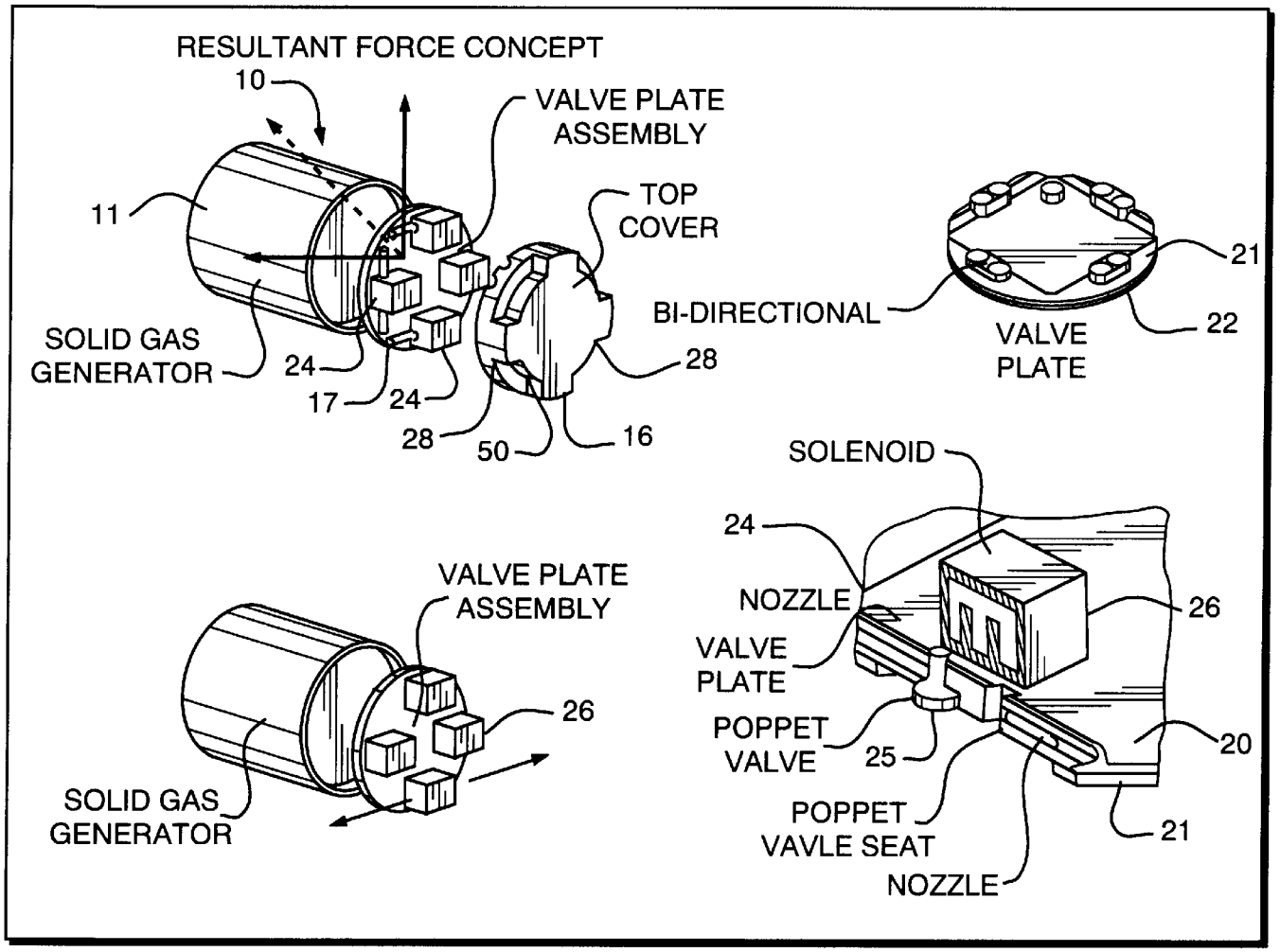
FIG. 9 is a schematic view showing a nose insert for a bomb.
Figure 11:
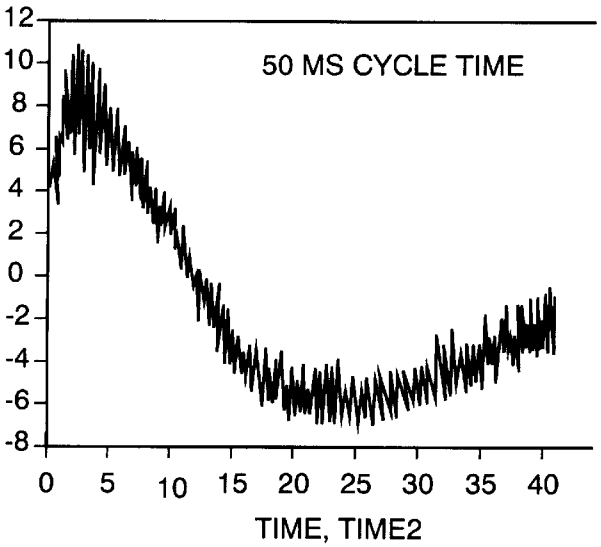
FIG. 11 is a graph illustrating the ability of the device to track the required angle of attack when the force states are changed at a 50 ms/cycle time of the valving of the device.
Figure 12:
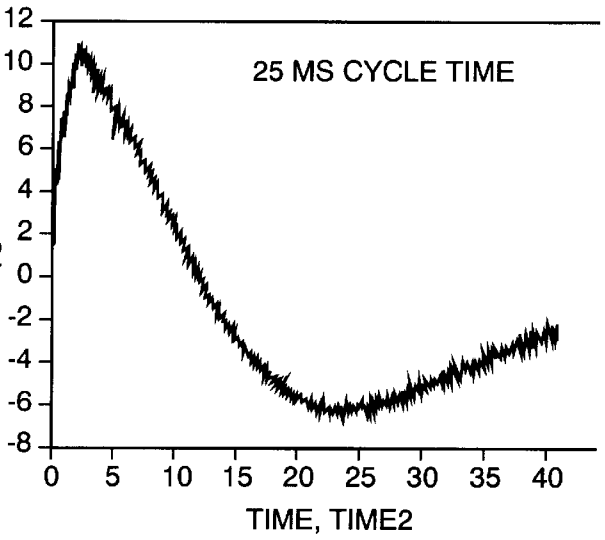
FIG. 12 is a graph illustrating the ability of the device to track the required angle of attack when the force states are changed at a 25 ms/cycle time with the same valve displacement.
Figure 10:
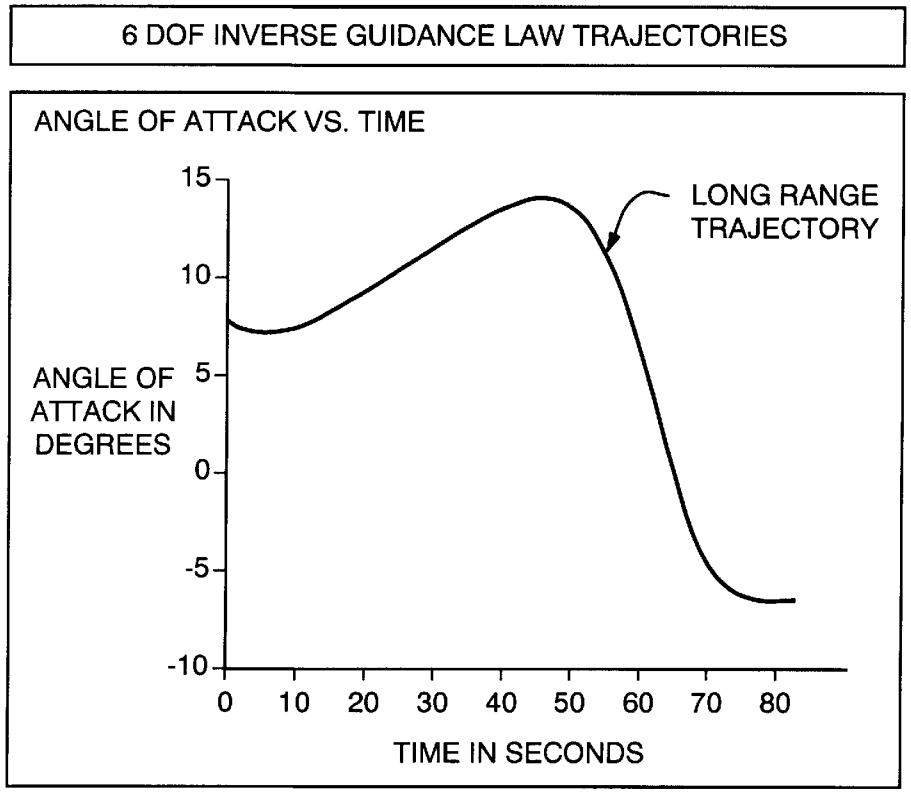
FIG. 10 is a graph illustrating a typical bomb trajectory expressed in terms of angle of attack.

With reference to FIGS. 9 and 16 in the drawings, in accordance with the invention, the device, generally indicated by reference character 10 includes a cylindrical tube 11 adapted to be inserted into the fuse well 12 of a conventional aircraft launched bomb 13. It includes a relatively larger cylindrical housing 14 forming a propellant canister 15, and mounting a valve-like cover 16 enclosing a valve plate assembly 17.

As best seen in FIG. 9 in the drawings, the assembly 17 includes first and second parallel plates 20 and 21 defining a channel 22 interconnecting the propellant canister 15 with a valve seat 23, in turn communicating with each of a plurality of bi-directional nozzles 24 which provide thrust in a selective manner in each of two opposite directions. Poppet valves 25 control gas flow to each of the valve orifices, and are moved from opened to closed position by electrical solenoids 26. The solenoid, when activated, picks up on a rocker arm (not shown) having its pivot between the solenoid and the poppet valve. The lift on the rocker arm located under the solenoid depresses the poppet valve opening the valve to allow gas to flow to the nozzle.

Figure 6:
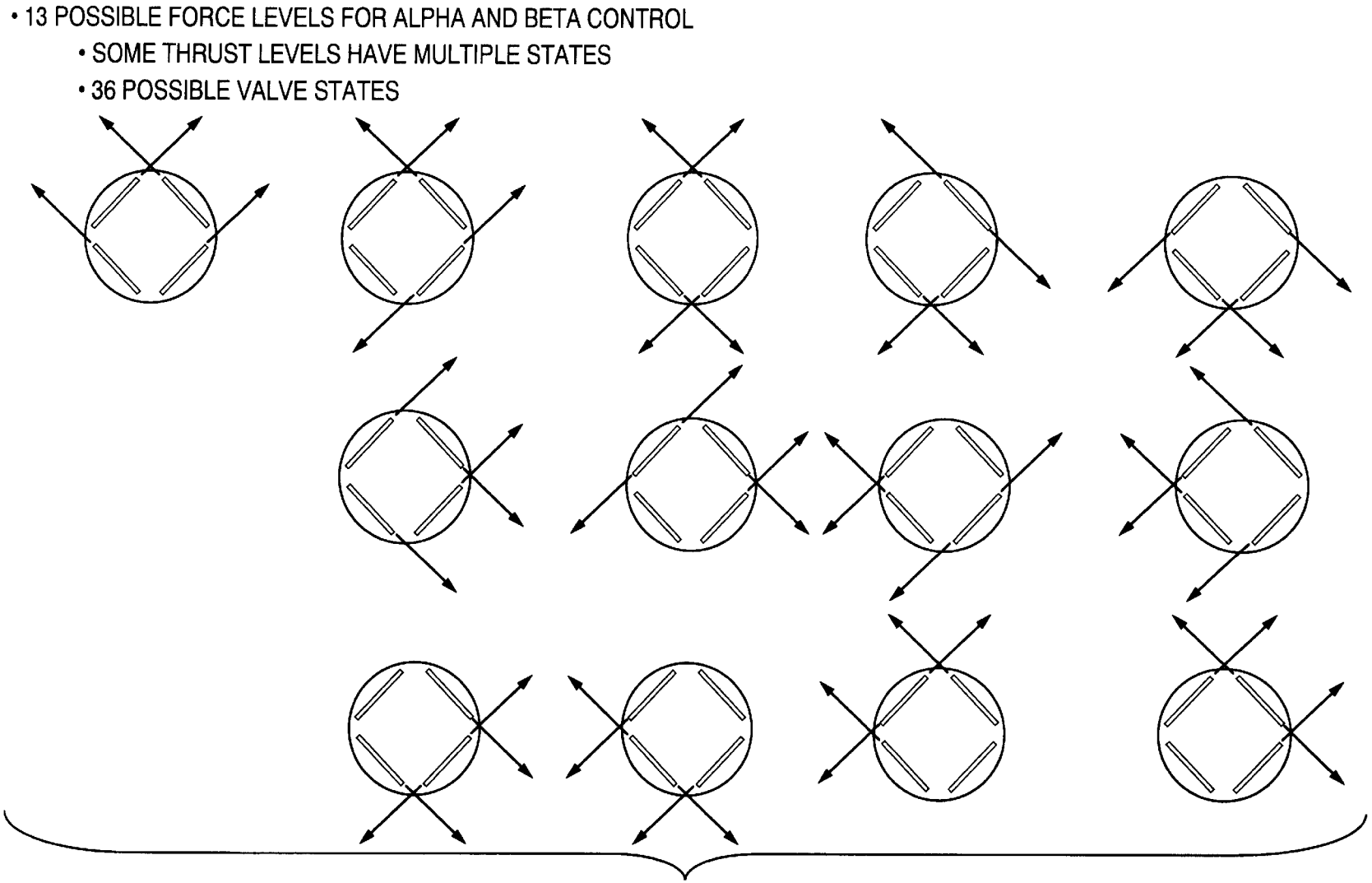
FIG. 6 is a schematic view illustrating thirteen possible force levels for alpha and beta control.

As will more fully appear, the valves are typically one-quarter inch in diameter at the seating surface, and are of a very low mass so as to be cyclable in periods as small as 20 milliseconds (see FIG. 6). Total valve excursion can be as little as 0.07 to 0.1 inch. FIG. 1 depicts the case where adjacent nozzles are opened which provides a resultant force which passes through the centerline of the assembly. The case where opposite nozzles are opened which provides a resultant force through the centerline of the assembly with two equal but opposite torques is also shown. In addition, the null state where both poppet valves in a bi-directional nozzle are opened with no net resultant force is pictured.

The valve plate cover 16 (FIG. 9) is adapted to override the valve plate assembly, and includes an end wall 28 as well as a cylindrical side wall 29 having four openings 50 which overlay the jet orifices.

Figure 2:
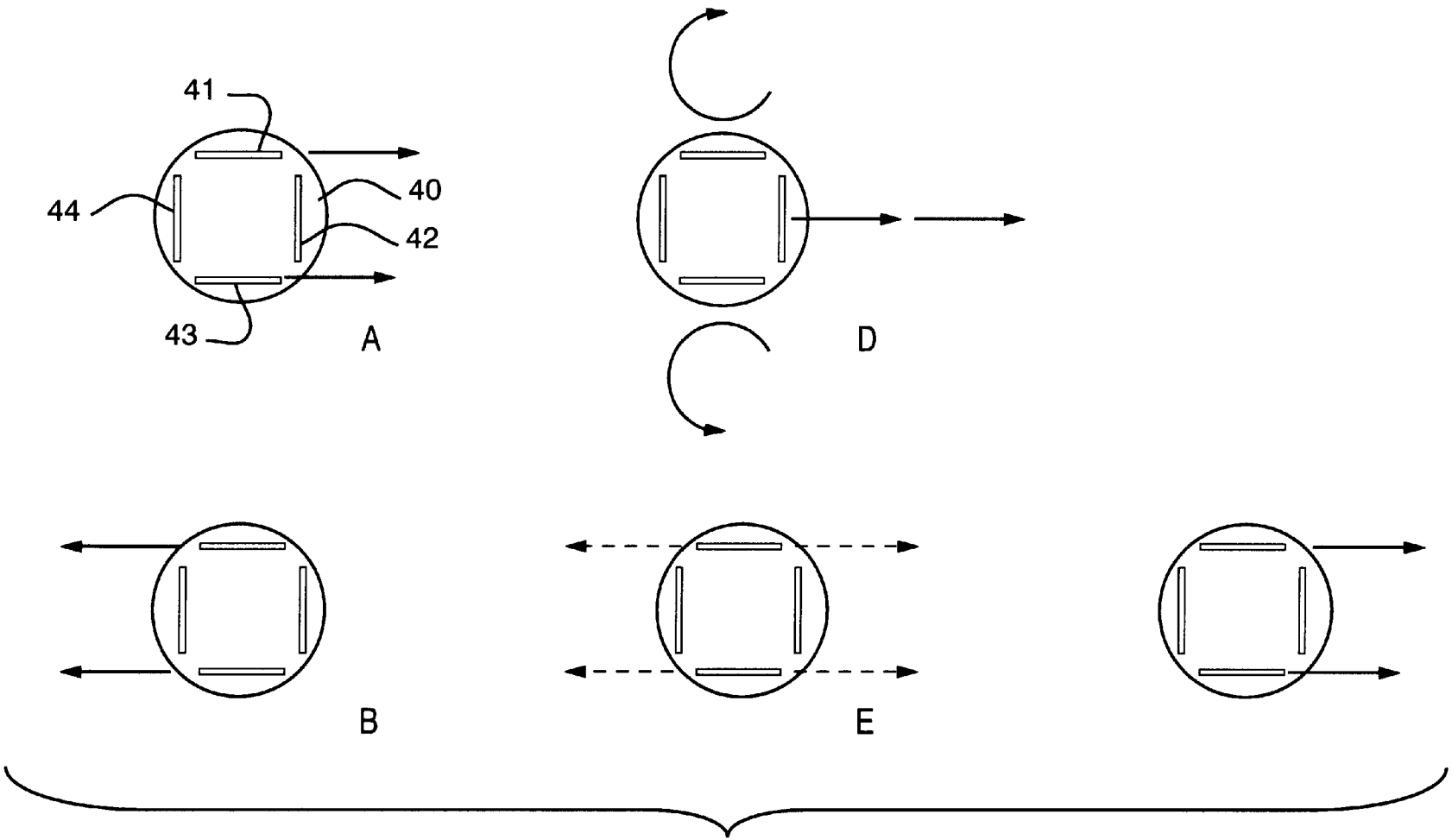
FIG. 2 is a schematic diagram showing plural thrust states selectively available using the disclosed embodiment.

Referring to FIG. 2 in the drawing, there is illustrated schematically an adjacent nozzle pitch plane, and the thruster states which are selectively obtainable using the four bi-directional nozzles.

Figure 3:
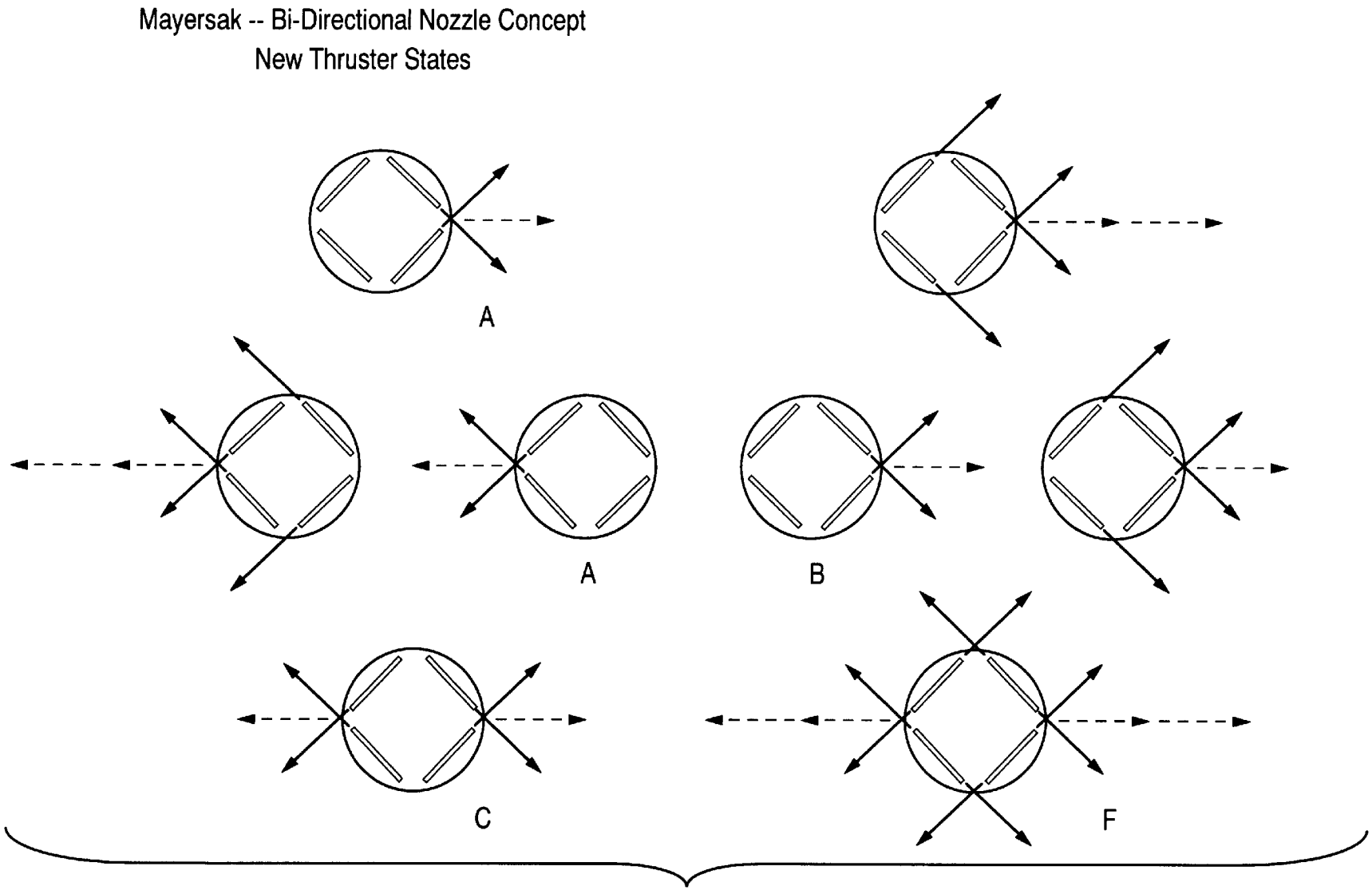
FIG. 3 is a schematic view showing force states developed at 45 degrees by firing opposite nozzles in the same direction which results in a resultant force through the centerline of the air vehicle with two canceling torques in defining the directional states.

Referring to FIG. 2, the thrust plane 40 mounts a first pair of nozzles 41, a second pair of nozzles 42, a third pair of nozzles 43 and a fourth pair of nozzles 44, each pair being disposed at 90 degrees with respect to adjacent pairs of nozzles. In FIG. 3, one orifice of an adjacent pair of bi-directional nozzles illustrates two forces disposed at a mutual 90 degree angle to provide a resultant force which passes through the longitudinal axis of the bomb normal to the thrust plane. As will become more clearly apparent, normally four orifices will be open at any one instant in order to maintain a substantially constant gas pressure emanating from the gas generator. FIG. 18 illustrates the use of four orifices, one orifice in each of the four bi-directional nozzles facing rightwardly to provide a lateral resultant thrust force which is that illustrated in FIG. 1*a*. FIG. 1*c* illustrates a similar situation where a thrust force is directed 180 degrees opposite to that seen in FIG. 2*b*. FIG. 2*d* corresponds to an oppositely directed force with respect to that shown in FIG. 2*a*. FIG. 2*e* illustrates two nozzle orifices facing leftwardly, and two nozzle orifices facing rightwardly so that the thrust forces cancel each other and a null force level is obtained. This can also be accomplished by using all eight nozzle orifices as shown in FIG. 3*f*.

Referring to FIG. 3, there is illustrated a group of conventional thruster states located at 45 degree angles from the normal bi-directional states. In FIG. 3*a* a thrust is delivered in a leftward direction using two nozzle orifices. An oppositely directed force is illustrated in FIG. 3*b*. FIG. 3*c* shows the orifices employed in FIGS. 3*a* and 3*b* together to achieve a null force state. FIG. 2*d* illustrates how the combined forces in FIG. 3*b* result in a resultant force through the centerline of the air vehicle or the longitudinal axis of the bomb with two torques of equal magnitude but opposite direction canceling each other so that no torque or roll component is generated.

Figure 5:
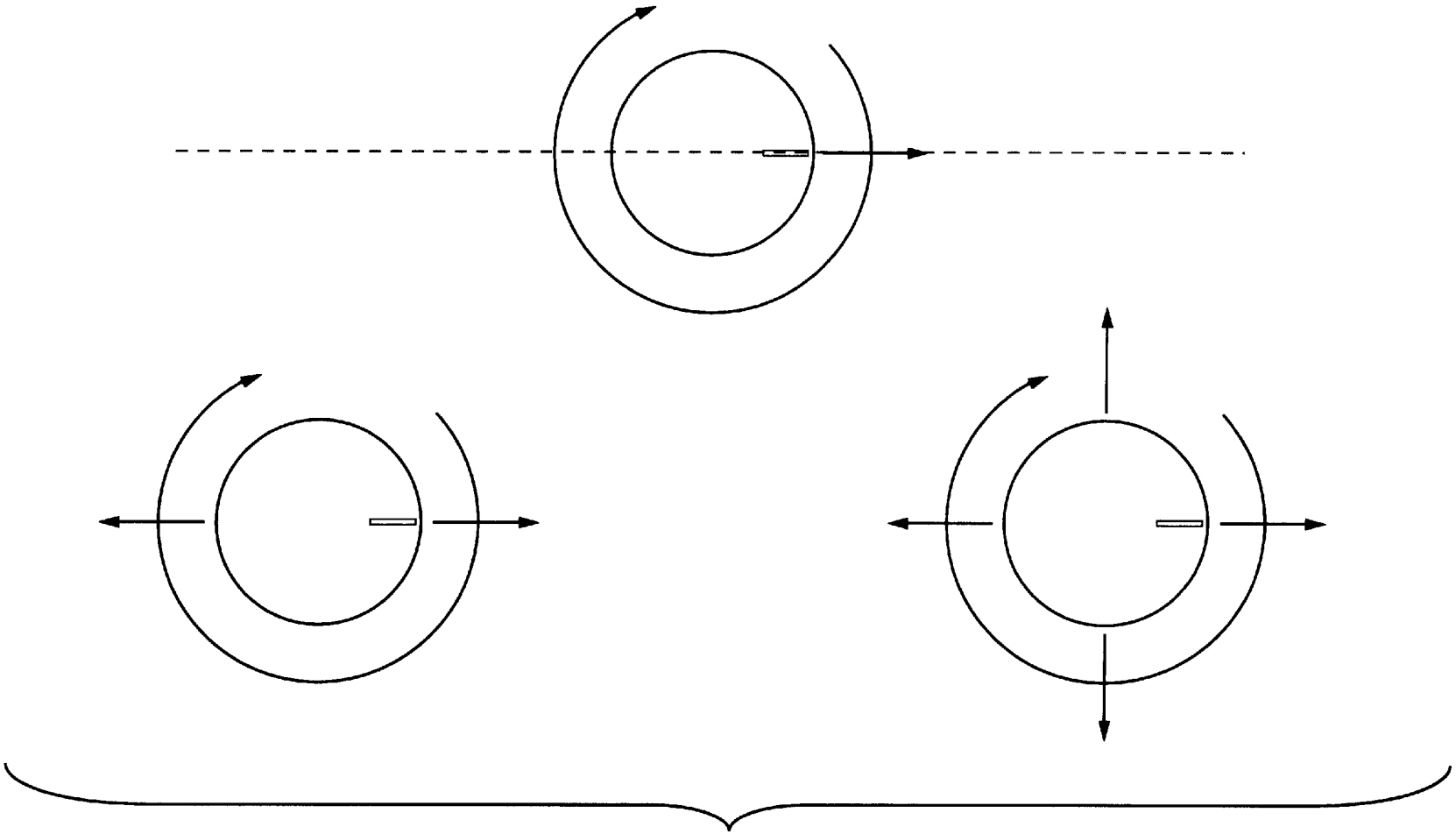
FIG. 5 is a schematic view illustrating a constant jet pressure concept with four nozzles operating at all times.

FIG. 5 illustrates pitch plane force levels where four nozzles are open at all times to provide the ability to operate with constant propellant pressure. This approach eliminates the need for feedback control, pressure regulators or pressure relieve valves in the solid gas generator. FIG. 1 illustrates two orifice openings which provide a rightward thrust in the plane with two other orifices providing thrust which mutually cancel each other. FIG. 2*e* shows an alternate four nozzle null state where the pitch plane up force is cancelled by the pitch plane down force. FIG. 3*c* details an alternate null state with all of four parallel forces canceling each other.

Figure 4:
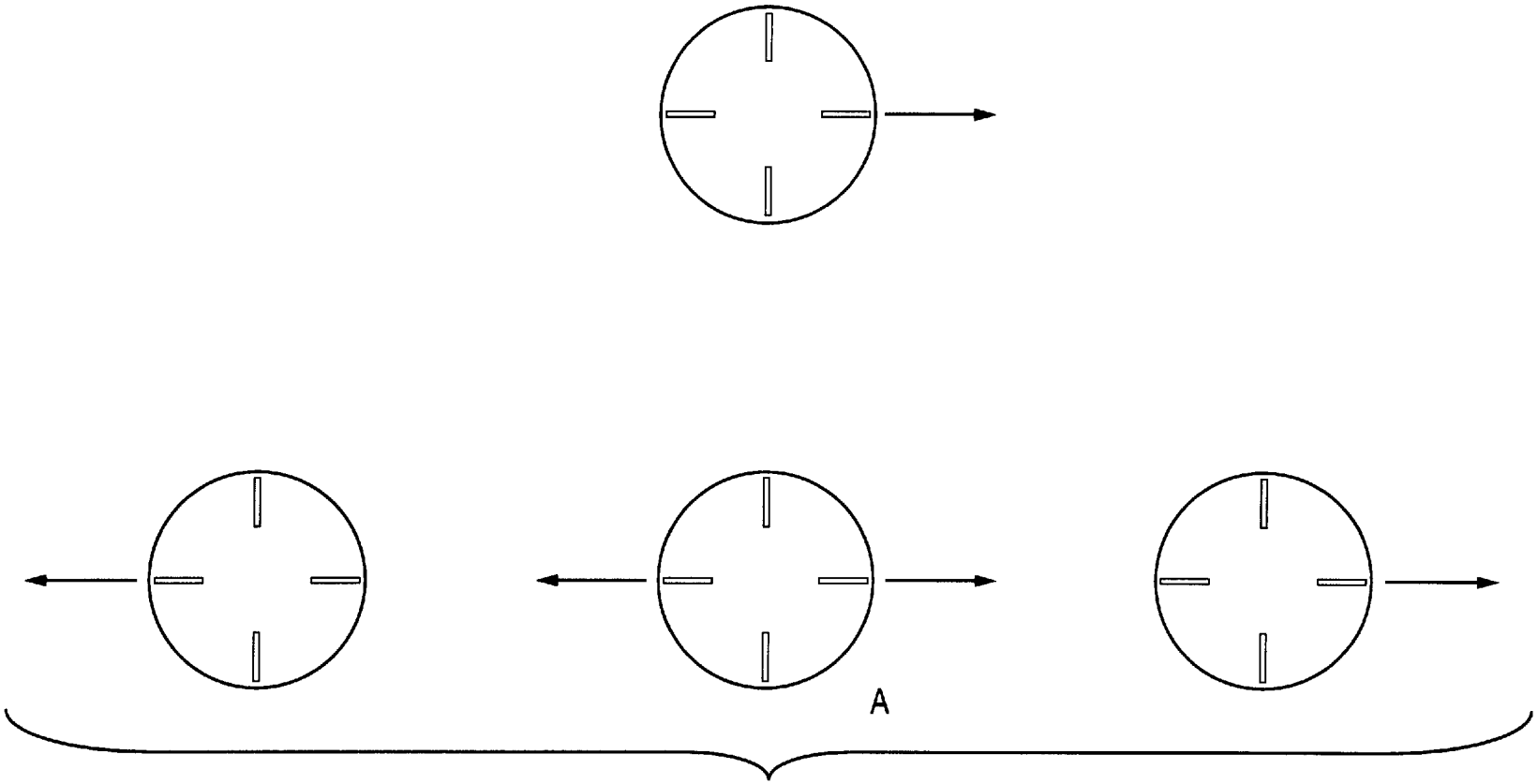
FIG. 4 is a schematic view showing combined force states with null states for one bi-directional nozzle.

FIG. 5 further illustrates the concept of keeping four nozzles open at all times to maintain constant pressure from the gas generator while generating forces in a control plane rotated 45 degrees from the pitch plane shown in FIG. 4. FIG. 3*a* shows a pair of immediately adjacent nozzle orifices each providing a thrust force disposed at a mutual right angle. As a result, two of the forces cancel each other leaving an effective thrust force at 120 degrees. FIG. 3*c* illustrates a null state with forces canceling each other.

FIG. 6 illustrates thirteen possible force levels for alpha and beta control. While thirteen possible force levels are illustrated, it will be understood that there are thirty three possible valve states capable of selectively imparting thrust at each of 45 degree intervals with single or double force.

Figure 7:
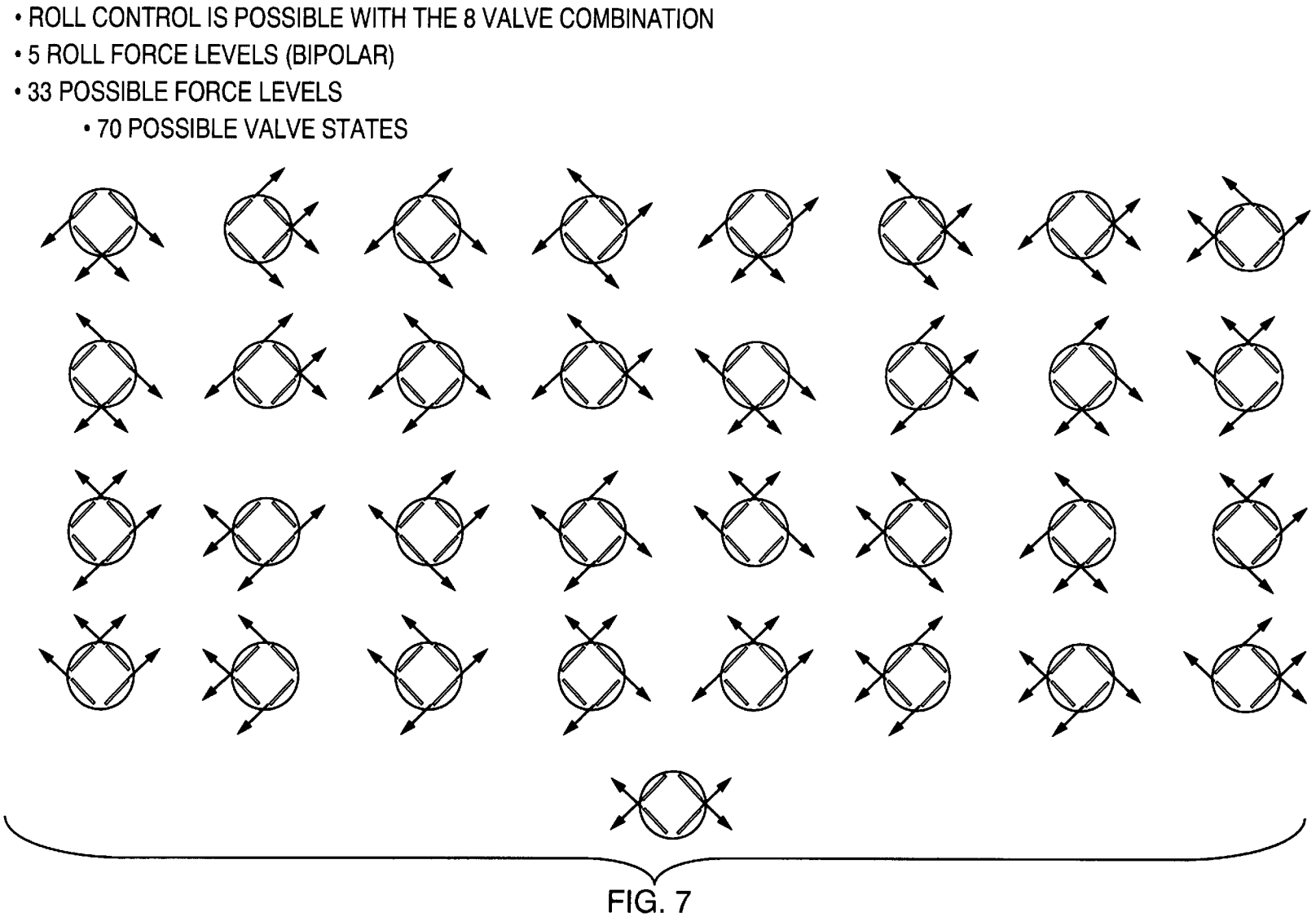
FIG. 7 is a schematic view showing the disclosed system 33 force states employed for alpha and beta control with roll control to include processional movement.

FIG. 7 illustrates the force states when the pitch and yaw force states include roll force states. Roll control is possible.

using any of the eight valve nozzles in correct combination. It is possible to use each of four orifices to impart torque without other thrust force. It is also possible to use two orifices to impart torque and the other two orifices to impart lateral thrust. This combination may be employed such that the lateral thrust is possible in each of eight directions located at 45 degree intervals around the center of the thrust plane. There are five roll force states available. There are thirty three possible force states possible when roll control is included.

Figure 8:
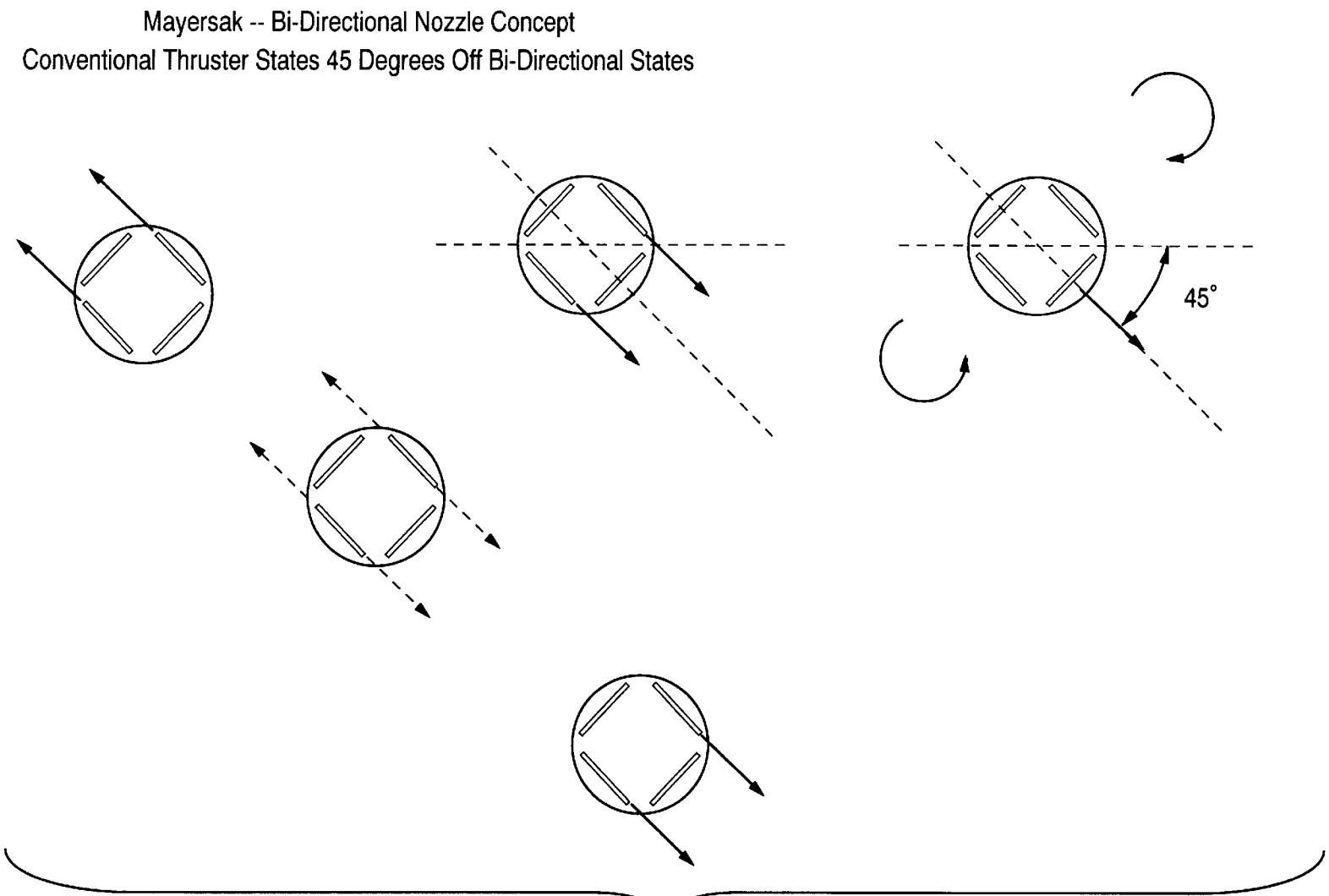
FIG. 8 is a schematic view showing four valve constant pressure states without bi-directional null.

FIG. 8 illustrates alternate control states without employing the null nozzle concept, where desired.

Referring again to FIG. 16, there is illustrated the installation of the system in the nose fuse well of the bomb with the fuse system being provided at the tail of the bomb, so that the resulting overall length of the bomb is at acceptable limits. This permits the bomb to be used within existing bomb bays of aircraft without substantial modification. It also permits the use of existing bomb inventory without any modification to the bomb itself to yield a GPS inverse guided concept.

FIGS. 17*a* and 17*b* illustrate a typical inverse guidance law trajectory executed by a bomb over a time of flights slightly over one minute. The data is provided in terms of angle of attack plotted against time where the angle of attack is determined for a vertical plane trajectory for ease of explanation. It may be observed that the bomb has a variety of angles of attack at either a positive or negative angle, either of which provides body lift which may be utilized to provide force to supplement that provided by the jet nozzle combination used at any given instant.

FIG. 17*a* illustrates the cycle time of the poppet valve at a 50 millisecond cycle rate. It illustrates the fact that the jet reaction control system changing force states twenty times a second can track the required angle of attack to the required accuracy.

FIG. 17*b* illustrates a 25 millisecond cycle rate with the force states changing 40 times a second. The angle of attack required is achieved with excellent accuracy. The response time of the poppet valve is of the order of 10 milliseconds. The length of stoke of the poppet valves in these simulations were all 0.10 inches.

FIG. 7 illustrates the five force states employed in determining the usage of the states in an example trajectory. These force states all employ a four nozzle open configuration. The example assumes the usage rate of the various valve states for a pitch plane with no roll control. The five firing states generated for the valves are employed where the valve orifices are used for vertical and horizontal pitch control. It is noted that two levels of force are available for each of upward and downward lateral thrust. In the case of the first level of thrust, only two nozzle orifices are used with the other pair of orifices providing neutral thrust.

Figure 14:
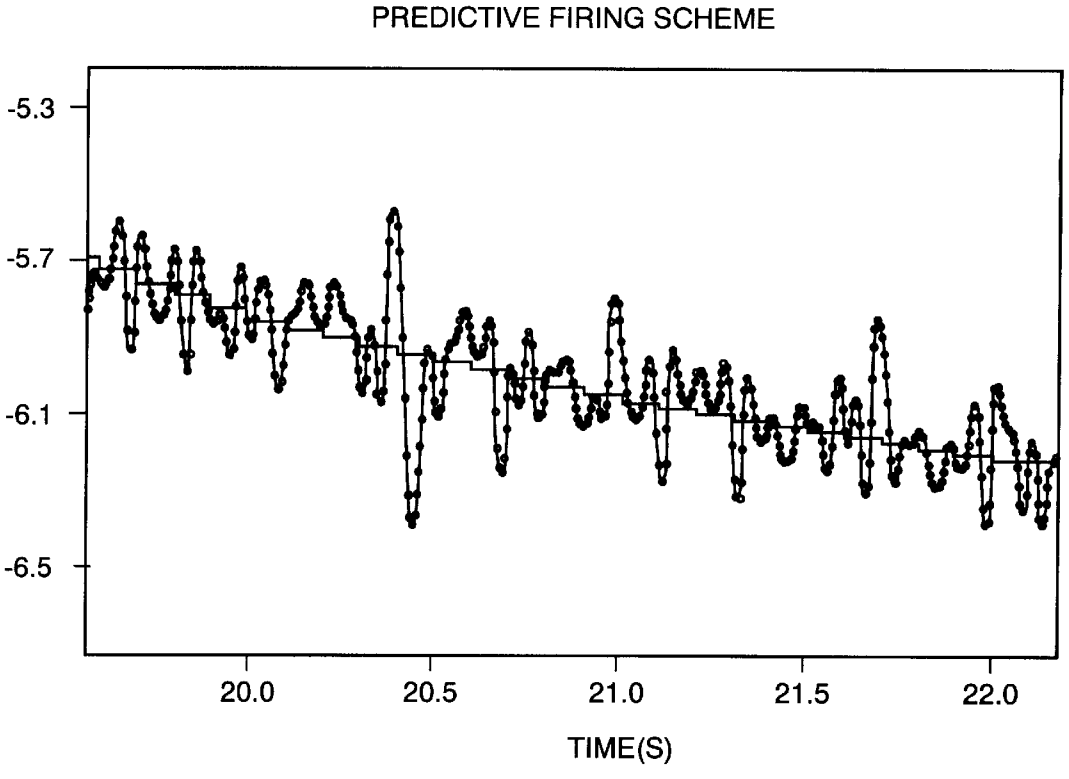
FIG. 14 describes the ability of the device to track the required angle of attack using five firing states associated with a two dimension control of the trajectory in the vertical plane including a null state in both up and d firings and a summary of the percentage a particular force state is used.
Figure 13:
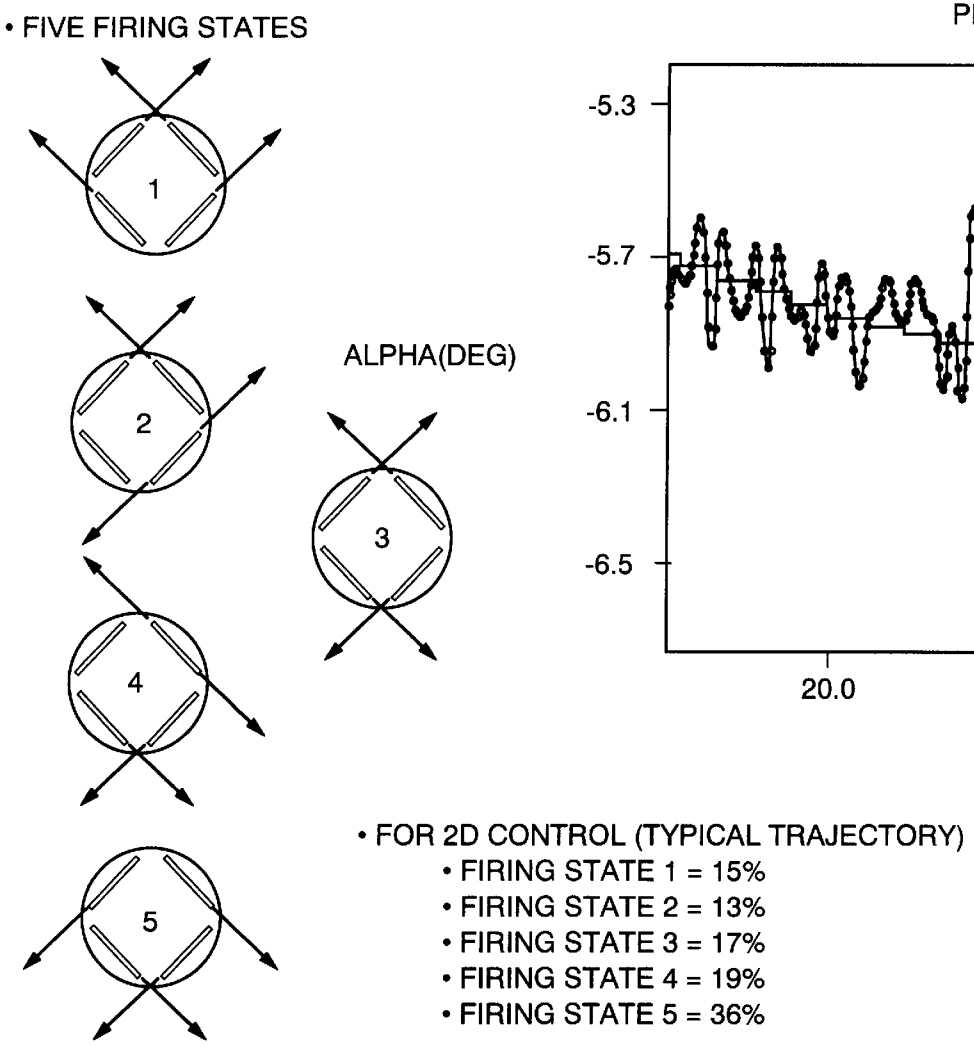
FIG. 13 depicts the force states for a two-dimensional control of a trajectory in the vertical plane.

FIG. 14 illustrates a predictive firing scheme utilized over a period of approximately two seconds during the trajectory of a bomb showing the percentage of use of each of the firing states shown in FIG. 7. As might be expected, the most common force state employed during the trajectory is one which pitches the nose up which is employed in this simulation thirty-six percent of the time. It is also noted that a neutral state is used seven percent of the time indicating the importance of being able to generate a neutral state with four valves open so that a constant pressure solid gas generator system can be used.

FIG. 14 describes a concept where the poppet valves remain in identical positions in the valve plate but the nozzles are rotated 45 degrees from their current positions. The nozzles which are controlled by a single dual solenoid. are at 90 degrees one to the other. The system employs eight poppet valves with four dual solenoids and, like the concept previously discussed, has four nozzles open at all times to allow a constant pressure working fluid supply to be employed eliminating the need for feedback control, venting or pressure relieve valves in the system.

Figure 15:
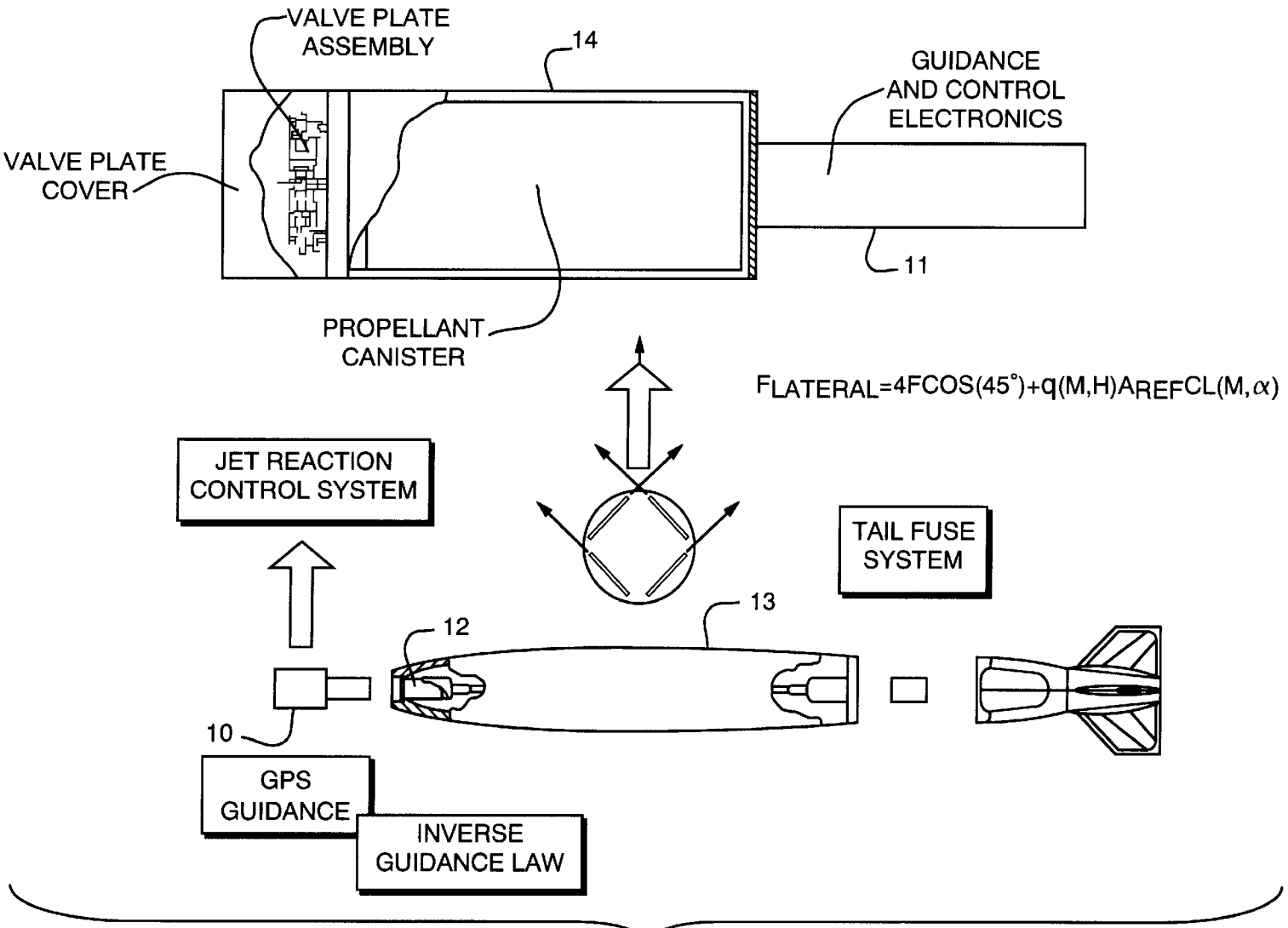
FIG. 15 defines an alternate nozzle geometry obtained by rotating each of the nozzles 45 degrees to form a bi-directional nozzle with the nozzles positioned such that there is a 90 degree angle included between the, nozzles making up the original bi-directional nozzle.

FIG. 15 illustrates the force states for the alternate nozzle geometry where each of the two bi-directional nozzles are rotated 45 degrees so that the nozzles controlled by a dual solenoid are at 90 degrees to each other. This configuration generates five roll force states and 33 force states identical to the concept previously discussed which employed four bi-directional nozzles.

The relationship of the nozzles can be defined in simple terms. If the number of nozzles is eight, then the angle between nozzles is 360 degrees divided by four, where four is equal to N and the number of nozzles is equal to 2N. A general case can be described where an integer, N, is selected and the number of nozzles is determined to be 2N. The angular spacing between nozzles is 360 degrees divided by N. In the example, N was taken to be 12 so that the number of nozzles required will be 24. The number of dual solenoids would be 12. Where N is 12, the jet reaction control system is capable of putting force into twelve separate control planes separated by 15 degrees.

The concept can also be used for tail control and for center of gravity control. It can be used to control the vehicle in much the same way as the previously described concept with the exception that the maneuver now does not benefit from the lift force generated by cross flow drag over the air vehicle. In this case, the nozzles and propellant supply have to be provided to generate sufficient force to move the total weight of the air vehicle. In the same sense, a tail control concept similar to the nose control concept can be defined. In the tail control concept the body lift would provide the maneuver force but the body lift would be decreased by the amount of force generated by the jet reaction control system, that is to say, in order to push the air vehicle nose up to generate body lift up, the tail has to be pushed down in the opposite direction so the total force would be less than if a nose control concept was employed where the force is additive.

It may thus be seen that I have invented a novel and highly useful improvements in a system for obtaining an extremely precise guidance of an airframe, typically a bomb, after launch from an aircraft, over its trajectory to a designated target. By providing a combination of four bi-directional nozzles each capable of thrust mutually opposite directions, which are spaced at 90 degree intervals about the longitudinal axis of the airframe, and disposed in the nose portion of the airframe, it is possible to obtain guidance forces in small increments on a continuous basis reducing the possibility of over correction with each lateral deviation. By providing a mode of operation in which half of the nozzle orifices at any instant are opened it is possible to maintain a substantially constant gas pressure from a gas generating device, thus eliminating the need for separate pressure venting means and any control systems associated therewith. Since valve control is accomplished by electric solenoid actuation, commands in terms of electrical signal may be obtained by using non-navigational systems.

It may thus also be seen that I have invented a novel and highly useful variant of the concept which allows 2N nozzles, where N is an integer, to be defined in such a way to place forces in N control planes separated one from the other by 360 degrees divided by 2N in a generalized embodiment of my invention. This provides the ability to change force states in N control planes at a high rate insuring very precise control of an air vehicle.

Further, the concept which I have invented can be used in jet reaction nose control concepts as well as concepts which employ tail control and control through the center of gravity of the air vehicle. While the force levels may vary in each implementation the concept to be employed remains the same. The ability to change the force states up to 50 times; or more, per second allows precise control of space vehicles or vehicle maneuver outside the atmosphere as well as endoatmospheric vehicles. Clearly, the concept which I have invented has application in control of vehicles in atmospheric flight as well as space flight.

I wish it to be understood that I do not consider the invention to be limited to the precise details of structure shown and described in the specification, for obvious modifications will occur to those skilled in the art to which the invention pertains.

I claim:

1. A system for guiding an airframe during flight to a target comprising: a generally planar plate element having an accurate peripheral edge, a plurality of bi-directional jet nozzle elements positioned at said peripheral edge of said plate element, a gas generator element supplying gas to said plate element, said plate element supplying gas to said jet nozzle elements; each of said nozzle elements having bi-directional valve elements having a pair of solenoids and dual action solenoid controlled poppet valves for directing gas flow through said bi-directional nozzle elements; means for controlling said poppet valves to present a constant exit area, gas generated to allow said generator to operate without pressure regulation, said means simultaneously opening certain other of said valve elements to provide lateral incremental directional thrust.

2. A system in accordance with claim 1 in which said valves are cycled overtime increments of 10 to 100 milliseconds to allow the force states generated by the valves to be changed to provide precision control of the system.

3. A system in accordance with claim 1, in which said valves are operated in both open and closed direction by electric solenoids.

4. A system in accordance with claim 1, in combination with a vehicle having a principal longitudinal axis and nose and tail sections, said system being installed at said nose section, wherein the total vehicle guidance force includes the sum of jet reaction force and air vehicle aerodynamic lift.

5. A system for guiding an airframe, having a principal longitudinal axis and having nose and tail portions, over a guided trajectory from a point of launch to a target in which guiding forces are applied to said nose portion, said system comprising: four bi-directional jet nozzles arranged substantially in a plane normal to a said longitudinal axis, and positioned laterally in said plane from said axis at light angles relative to each adjacent bi-directional nozzle and each of said jet nozzles having first and second oppositely disposed orifices; gas generating means communicating with said nozzles, each of said orifices being controlled in such manner that four of said orifices are opened at any given instant to maintain substantially constant gas pressure.

6. A system for guiding an airframe, having a principal longitudinal axis and having nose and tail portions, over a guided trajectory from a point of launch to a target in which guiding forces are applied to said nose portion, said system comprising; four sets of bi-directional jet nozzles each arranged substantially in a plane normal to a said longitudinal axis, to form a 90 degree angle between adjacent nozzles, each bi-directional jet nozzle being controlled by a single dual action solenoid with each of said nozzle sets having the ability to generate a force at ninety degrees from the other, and capable of operating selectively one or the other or both nozzles to generate forces, when operated with the other nozzle sets, in N control planes; gas generating means communicating with said nozzles, each of said orifices being controlled in such manner that four of said orifices are opened at any given instant to maintain substantially constant gas pressure.

7. A system for guiding an airframe, having a principal longitudinal axis and having nose and tail portions, over a guided trajectory from a point of launch to a target, said system comprising an arbitrary even number of sets of nozzles, 2N, arranged substantially in a plane normal to said longitudinal axis, with adjacent nozzles forming an angle equal to 360 degrees divided by N between any two sets of nozzles and controlled by a single dual action solenoid with each of said jet nozzle sets having the ability to generate force at 360 degrees divided by N from the other nozzle sets and being capable of selectively operating one or the other or both nozzles at the same time to place control forces, operating with other nozzle sets in N control planes; gas generating means communicating with said nozzles, each of said nozzles being controlled in such manner that four of said nozzles are opened at any given instant to maintain substantially constant gas pressure.

8. A system in accordance with claim 7, in which said orifices are opened and closed by means including reciprocating solenoid controlled poppet valves at high rates to allow the control states to be changed many times per second.

9. A system in accordance with claim 7, in which oppositely directed nozzles, are selectively opened to provide a null force state, with the remaining nozzles providing a laterally directed thrust.

10. A system in accordance with claim 7, in which all nozzles are capable of being simultaneously opened to provide a neutral thrust state.

11. A system in accordance with claim 7, in which said nozzles may be selectively opened to provide a net thrust left or right in N control planes.

12. A system in accordance with claim 7, in which at least two nozzles can be opened to provide a net roll force level for forced roll or roll control to a specified angular airframe control scheme.

13. A system in accordance with claim 9, in which a second additional pair of nozzles provides a neutral thrust state.

14. A system in accordance with claim 7, said system being positioned at the tail portion of said airframe wherein the control force generated is the difference between the airframe lift and the jet reaction force.

15. A system in accordance with claim 7, said system being positioned at the center of gravity of the airframe to provide control force guidance without body lift.

16. A system in accordance with claim 7, said system being positioned at the nose portion of said airframe, wherein the control force generated is the sum of the airframe lift and the jet reaction force.

* * * * *